US011695210B2

(12) United States Patent
Huang et al.

(10) Patent No.: US 11,695,210 B2
(45) Date of Patent: Jul. 4, 2023

(54) TERMINAL DEVICE

(71) Applicant: VIVO MOBILE COMMUNICATION CO., LTD., Guangdong (CN)

(72) Inventors: Huan-Chu Huang, Chang'an Dongguan (CN); Yijin Wang, Chang'an Dongguan (CN); Xianjing Jian, Chang'an Dongguan (CN)

(73) Assignee: VIVO MOBILE COMMUNICATION CO., LTD., Chang'an Dongguan (CN)

( * ) Notice: Subject to any disclaimer, the term of this patent is extended or adjusted under 35 U.S.C. 154(b) by 196 days.

(21) Appl. No.: 17/214,613

(22) Filed: Mar. 26, 2021

(65) Prior Publication Data

US 2021/0218143 A1 Jul. 15, 2021

Related U.S. Application Data

(63) Continuation of application No. PCT/CN2019/101510, filed on Aug. 20, 2019.

(30) Foreign Application Priority Data

Sep. 28, 2018 (CN) ..... 201811142604.4

(51) Int. Cl.
*H01Q 9/04* (2006.01)

(52) U.S. Cl.
CPC ..... *H01Q 9/0414* (2013.01); *H01Q 9/045* (2013.01); *H01Q 9/0435* (2013.01)

(58) Field of Classification Search
CPC ..... H01Q 9/0414; H01Q 9/0435; H01Q 9/045
See application file for complete search history.

(56) References Cited

U.S. PATENT DOCUMENTS

2007/0132642 A1 6/2007 Iluz et al.
2008/0218418 A1* 9/2008 Gillette ..... H01Q 9/045 343/700 MS
2013/0278468 A1* 10/2013 Yehezkely ..... H01Q 1/2266 343/702

(Continued)

FOREIGN PATENT DOCUMENTS

CN 2938452 Y 8/2007
CN 201910487 U 7/2011

(Continued)

OTHER PUBLICATIONS

CN Office Action dated Nov. 27, 2019 as received in Application No. 201811142604.4.

(Continued)

*Primary Examiner* — Dieu Hien T Duong
(74) *Attorney, Agent, or Firm* — Maschoff Brennan

(57) ABSTRACT

A terminal device is provided. The terminal device includes a feed, a metal frame, and a radiating patch. At least two grooves are disposed on an outer surface of the metal frame, two through-holes are disposed in each groove, the radiating patch is disposed in each groove, the metal frame is grounded, two antenna feeding points are disposed on each radiating patch, the feed is connected to one feeding point through one through-hole, the antenna feeding points in each groove are in a one-to-one correspondence with the through-holes, and each radiating patch is insulated from the groove by using a non-conducting material.

12 Claims, 6 Drawing Sheets

(56) References Cited

U.S. PATENT DOCUMENTS

2015/0188239 A1 7/2015 Tong et al.

FOREIGN PATENT DOCUMENTS

| | | | |
|---|---|---|---|
| CN | 203481374 | U | 3/2014 |
| CN | 108011182 | U | 5/2018 |
| CN | 108400424 | A | 8/2018 |
| CN | 109346829 | A | 2/2019 |
| EP | 2 477 275 | A1 | 7/2012 |
| JP | 2007-235592 | A | 9/2007 |

OTHER PUBLICATIONS

Written Opinion of the International Searching Authority dated Apr. 8, 2021 as received in Application No. PCT/CN2019/101510.

Dimitrijevic, et al., Analysis of Patch Antenna with Director in FDTD Simulation Environment, 2016 19th International Symposium on Electrical Apparatus and Technologies, pp. 1-4 (May 29, 2016).

Extended European Search Report dated Oct. 11, 2021 as received in Application No. 19867410.3.

* cited by examiner

TERMINAL DEVICE

CROSS REFERENCE

This application is continuation application of PCT International Application No. PCT/CN2019/101510 filed on Aug. 20, 2019, which claims priority to Chinese Patent Application No. 201811142604.4 filed in China on Sep. 28, 2018, the disclosures of which are incorporated herein by reference in their entireties.

TECHNICAL FIELD

The present disclosure relates to the field of communications technologies, and in particular, to a terminal device.

BACKGROUND

With the rapid development of communications technologies, multi-antenna communication has become a mainstream and a future development trend of a terminal device, and in this process, a millimeter-wave antenna is gradually introduced to the terminal device. In a related technology, the millimeter-wave antenna is usually in a form of an independent antenna module, and therefore, accommodating space needs to be disposed inside the terminal device for the independent antenna module. In this way, a volume of the entire terminal device is relatively large, resulting in relatively low overall competitiveness of the terminal device.

SUMMARY

Some embodiments of the present disclosure provide a terminal device, to resolve a problem that a volume of an entire terminal device is relatively large because accommodating space needs to be disposed for a millimeter-wave antenna inside the terminal device.

To resolve the foregoing technical problem, the present disclosure is implemented as follows:

Some embodiments of the present disclosure provide a terminal device, including a feed, a metal frame, and a radiating patch; where at least two grooves are disposed on an outer surface of the metal frame, two through-holes are disposed in each groove, the radiating patch is disposed in each groove, the metal frame is grounded, two antenna feeding points are disposed on each radiating patch, the feed is connected to one feeding point through one through-hole, the antenna feeding points in each groove are in a one-to-one correspondence with the through-holes, and each radiating patch is insulated from the groove by using a non-conducting material. In this way, the feed, the at least two grooves, and the radiating patch are equivalent to a millimeter-wave array antenna of the terminal device, and the metal frame is also a radiator of a non-millimeter-wave communication antenna. Therefore, accommodating space of the millimeter-wave antenna is saved, a volume of the terminal device can be reduced, and a metal appearance design can be better supported and can be compatible with a solution in which appearance metal is used as another antenna, thereby improving overall competitiveness of the terminal device.

BRIEF DESCRIPTION OF DRAWINGS

To describe technical solutions of some embodiments of the present disclosure more clearly, the following briefly describes the accompanying drawings required for describing some embodiments of the present disclosure. Apparently, the accompanying drawings in the following description show merely some embodiments of the present disclosure, and a person of ordinary skill in the art may still derive other accompanying drawings from these accompanying drawings without creative efforts.

DESCRIPTION OF EMBODIMENTS

The following clearly describes the technical solutions in some embodiments of the present disclosure with reference to the accompanying drawings in some embodiments of the present disclosure. Apparently, the described embodiments are merely some but not all of the embodiments of the present disclosure. All other embodiments obtained by a person of ordinary skill in the art based on the embodiments of this disclosure shall fall within the protection scope of this disclosure.

Figure 1:
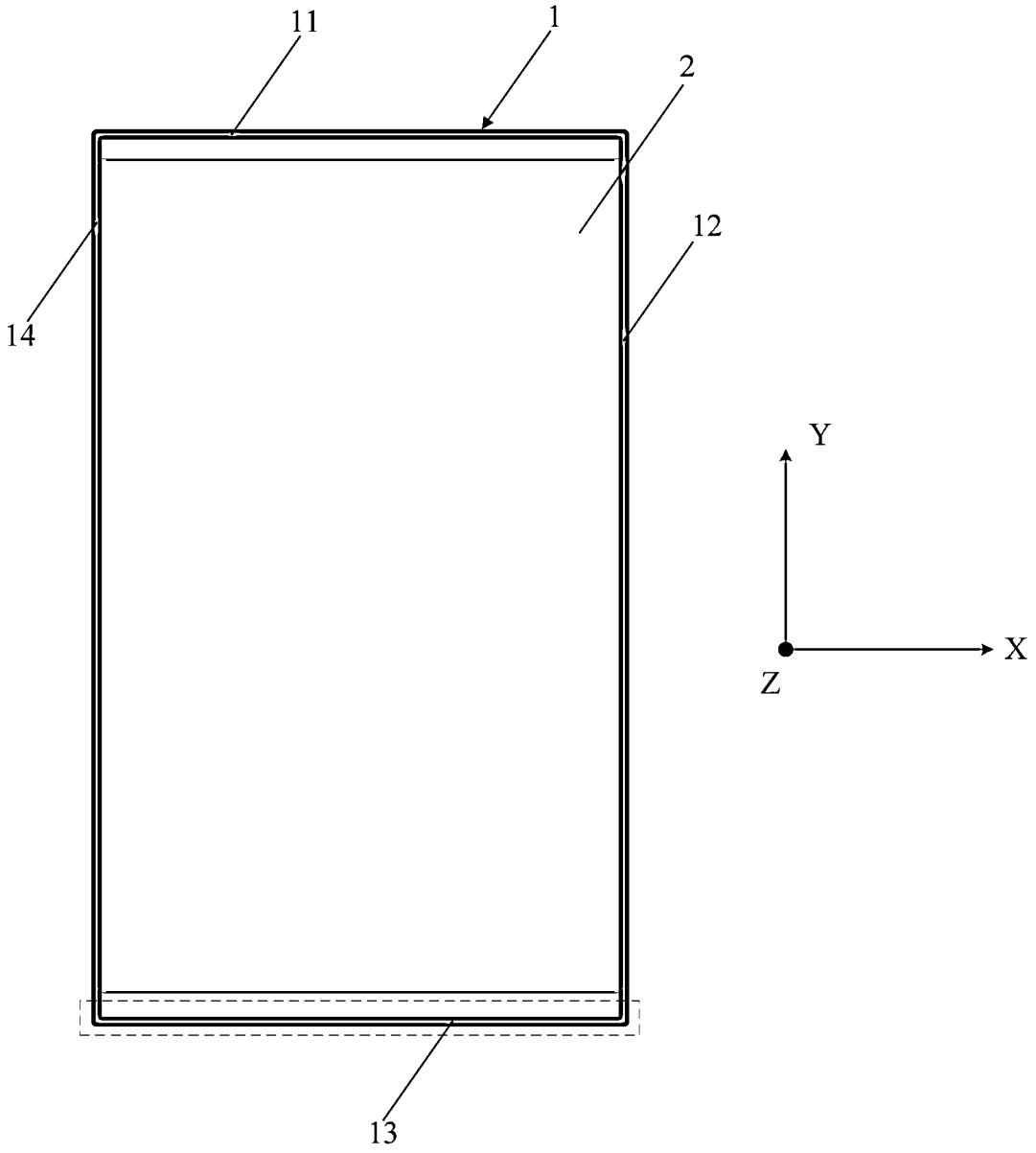
FIG. 1 is a schematic structural diagram of a terminal device according to some embodiments of the present disclosure.

FIG. 1 is a schematic structural diagram of a terminal device according to some embodiments of the present disclosure. As shown in FIG. 1, the terminal device includes a feed, a metal frame 1, and a radiating patch. At least two grooves are disposed on an outer surface of the metal frame 1, two through-holes are disposed in each groove, the radiating patch is disposed in each groove, the metal frame 1 is grounded, two antenna feeding points are disposed on each radiating patch, the feed is connected to one feeding point through one through-hole, the antenna feeding points in each groove are in a one-to-one correspondence with the through-holes, and each radiating patch is insulated from the groove by using a non-conducting material. The feed is a millimeter-wave feed.

In this embodiment, the metal frame 1 may include a first side 11, a second side 12, a third side 13, and a fourth side 14, and the metal frame 1 may be an end-to-end frame or a non-end-to-end frame. The metal frame 1 is grounded, and may be electrically connected to a floor 2 inside the terminal device, and the floor 2 may be a circuit board, a metal middle cover, or the like. The radiating patch may be a same metal conductor as the metal frame 1, to keep metal appearance of the terminal device.

Figure 2:
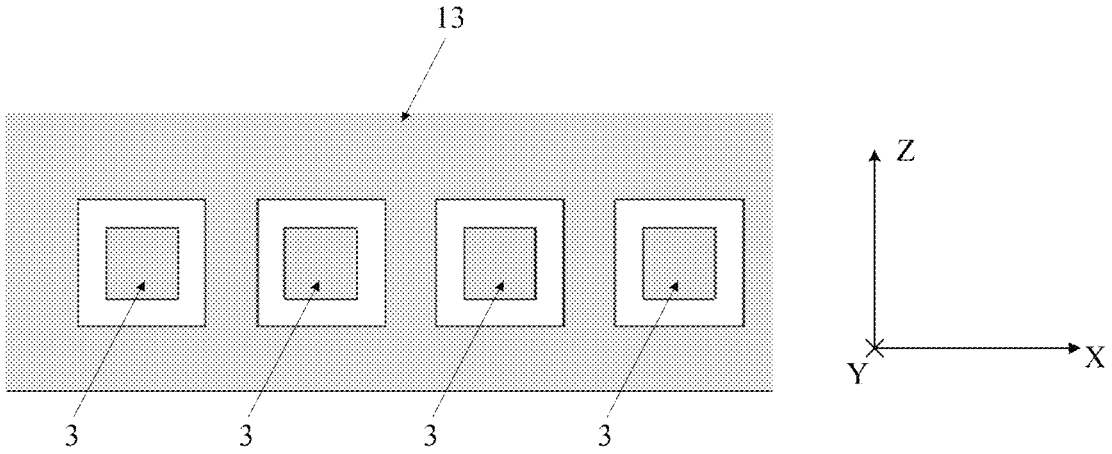
FIG. 2 is a schematic structural diagram 1 of a side of a metal frame according to some embodiments of the present disclosure.
Figure 3:
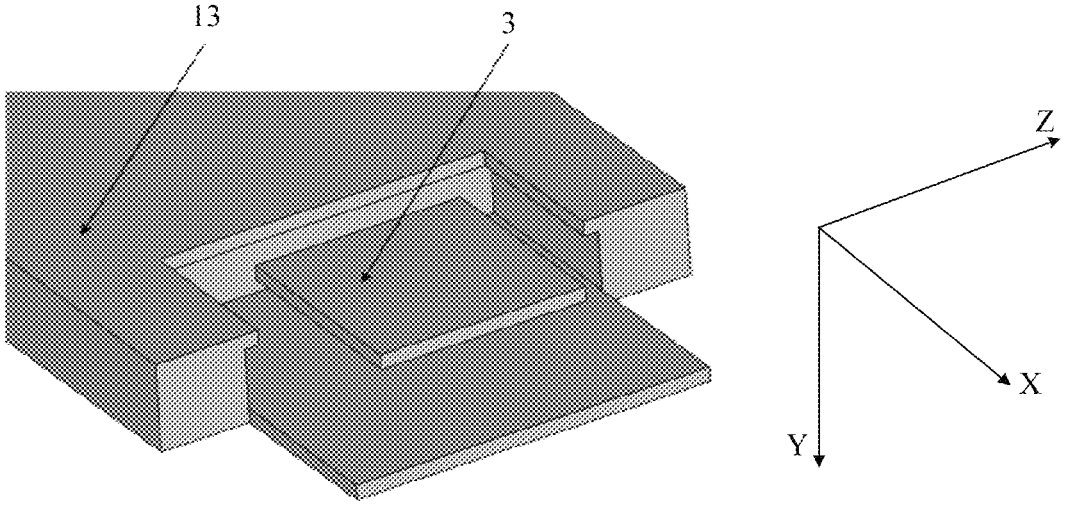
FIG. 3 is a schematic structural diagram 2 of a side of a metal frame according to some embodiments of the present disclosure.
Figure 4:
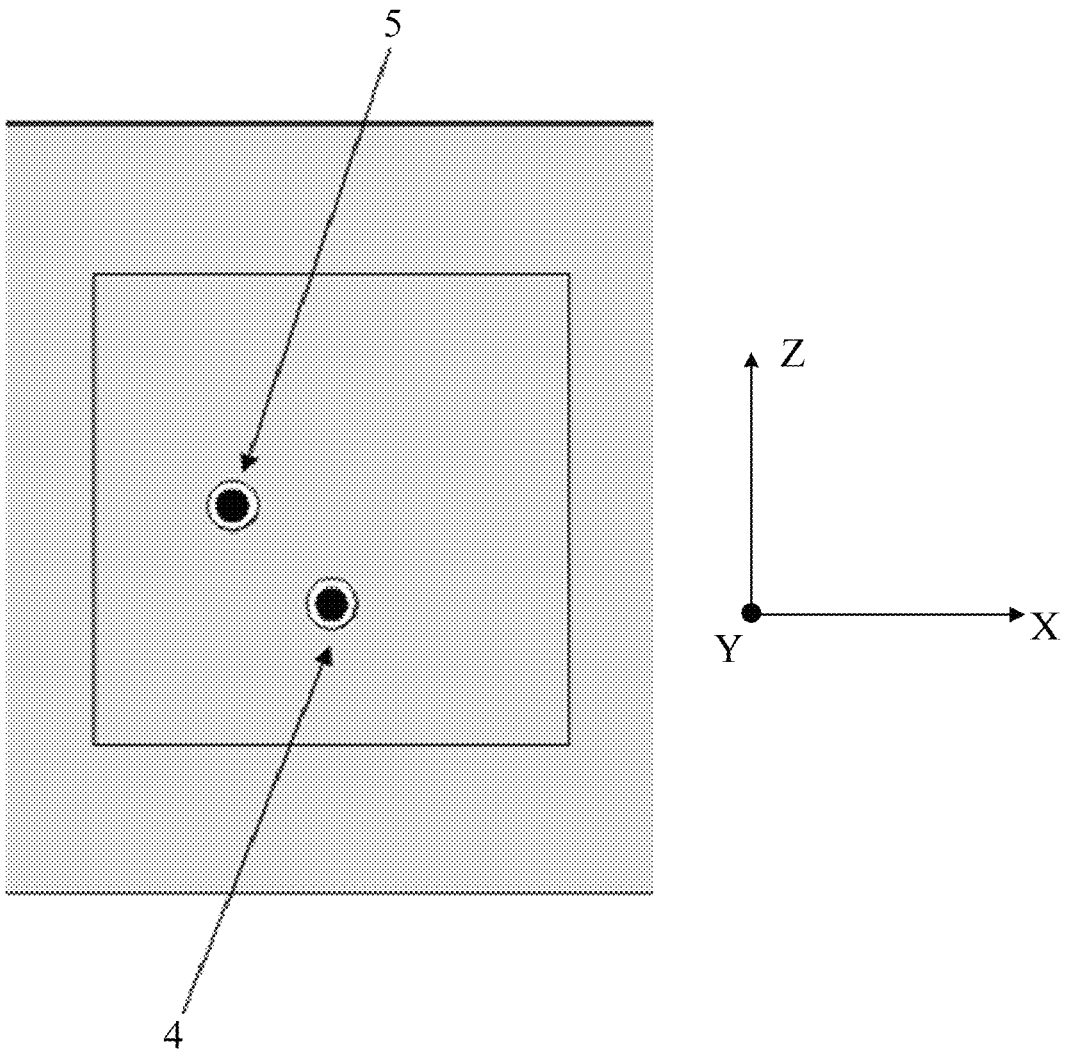
FIG. 4 is a schematic structural diagram 3 of a side of a metal frame according to some embodiments of the present disclosure.

In this embodiment, for better understanding of the foregoing setting manner, refer to FIG. 2 to FIG. 4. FIG. 2 to FIG. 4 are schematic structural diagrams of a side of a metal frame according to some embodiments of the present disclosure.

First, as shown in FIG. 2, multiple square grooves are opened on the third side 13 of the metal frame 1, and one radiating patch 3 is disposed in each groove. The radiating patch 3 forms a millimeter-wave antenna together with millimeter-wave signals of the groove and the feed, and multiple millimeter-wave antennas form a millimeter-wave array antenna. A non-conducting material is used to fill a groove between the radiating patch 3 and the metal frame 1. Optionally, a dielectric constant of the non-conducting material is 2.2, and loss tangent is 0.0009.

Refer to FIG. 3. There is a gap between the radiating patch 3 shown in FIG. 3 and each of the bottom and a sidewall of the groove, and each groove is filled with the non-conducting material. Refer to FIG. 4. Two through-holes are disposed at the bottom of the groove in FIG. 4 to access a feed signal of the millimeter-wave antenna, and a through-hole 4 may be used for access of a first feed signal, and a through-hole 5 may be used for access of a second feed signal. The first feed signal and the second feed signal access the bottom of the radiating patch 3, and are used to excite the millimeter-wave antenna to generate a radiation signal, to support a multiple-input multiple-output (MIMO) function.

Figure 5:
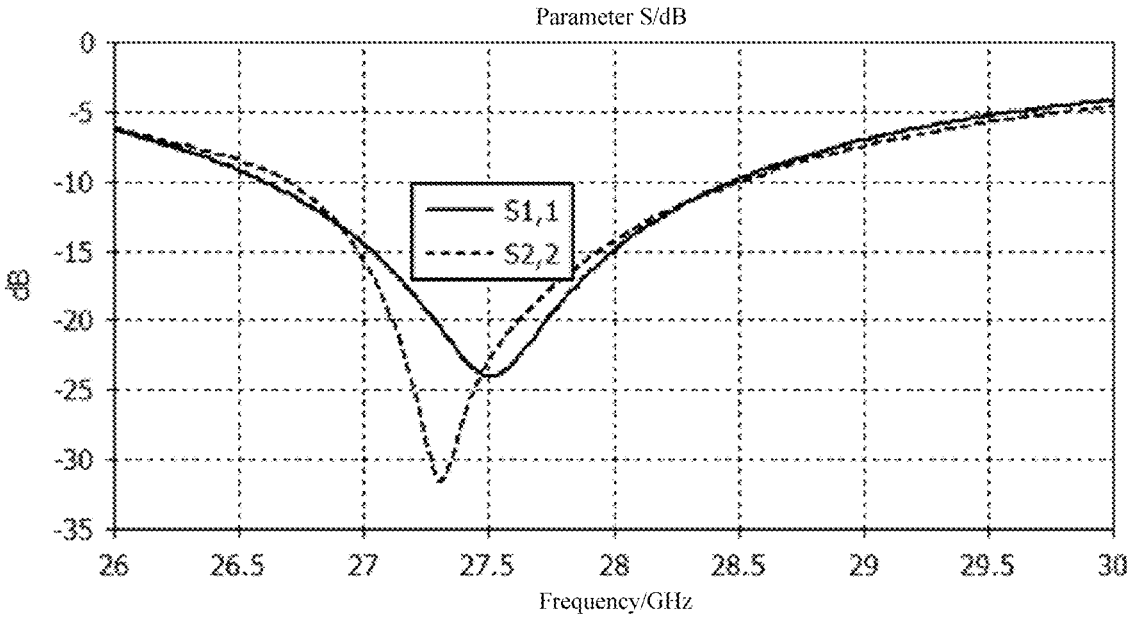
FIG. 5 is a schematic diagram 1 of a return loss of a single millimeter-wave antenna according to some embodiments of the present disclosure.

FIG. 5 is a schematic diagram of a return loss of a single millimeter-wave antenna according to some embodiments of the present disclosure. As shown in FIG. 5, (S1, 1) is a return loss formed by a feeding signal of a first feed signal, and (S2, 2) is a return loss formed by a feeding signal of a second feed signal. (S1, 1) is −10 dB to calculate bandwidth, so that 26.7 GHz to 28.5 GHz can be covered.

In this embodiment, at least two grooves are disposed on an outer surface of the metal frame 1, the radiating patch 3 is disposed in each groove, and each radiating patch is connected to the feed to form a millimeter-wave array antenna, to radiate a millimeter-wave signal. When at least two grooves are disposed on the third side 13, a communications antenna may be an area shown by dashed lines in FIG. 1, and the communications antenna is formed by the third side 13, a part of the second side 12, and a part of the fourth side 14. Certainly, in addition to that at least two grooves are disposed on the third side 13, at least two grooves may also be disposed on the first side 11, the second side 12, or the fourth side 14. This is not limited in this embodiment.

In this way, an existing antenna (for example, a cellular antenna and a non-cellular antenna) may be kept, and is compatible with a 5G millimeter-wave antenna; in addition, an original independent millimeter-wave antenna is integrated into an existing antenna inside the terminal device, to form a mm-wave antenna in non-wave antenna (AiA) solution design, or a solution design in which an original independent millimeter-wave antenna is integrated into an existing metal structure inside the terminal device. A size of the entire system does not need to significantly increased, a metal design (for example, a metal ring) of appearance can be kept, to achieve industrial design (ID) aesthetics, height symmetry, and the like. In addition, in a high screen ratio, when the terminal device is placed positively on a metal table (in other words, when a screen is facing up), the back of the terminal device is not blocked by the metal table, and a probability that performance of a millimeter-wave antenna is greatly reduced and user wireless experience is obviously deteriorated when the terminal device is held is avoided. In addition, the antenna itself may form a multiple-input multiple-output (namely, MIMO) function. During beam scanning of the millimeter-wave array antenna, similar performance can be achieved in a positive direction and a negative direction. In addition, based on a metal frame design of the terminal device, metal texture of the terminal device is not affected. The metal frame itself is used as a reflector of the millimeter-wave antenna to obtain a higher gain. The terminal device is integrated into a non-millimeter-wave antenna in which the metal frame is used as an antenna, the millimeter-wave antenna is compatible with the non-millimeter-wave antenna in which the metal frame is used as an antenna.

In this embodiment, the terminal device may be a mobile phone, a tablet personal computer (Tablet Personal Computer), a laptop computer (Laptop Computer), a personal digital assistant (PDA), a mobile internet device (MID), a wearable device (Wearable Device), or the like.

Optionally, two through-holes in each groove are located at the bottom of the groove.

In this implementation, two through-holes in each groove are located at the bottom of the groove, so that the radiating patch 3 is electrically connected to the feed by using a relatively short path, and the millimeter-wave antenna can have relatively good performance.

Optionally, a first straight line determined by one of the two through-holes at the bottom of each groove and a center of the bottom of the groove is parallel to a length direction of the metal frame 1, a second straight line determined by the other through-hole and the center of the bottom of the groove is parallel to a width direction of the metal frame 1, and the first straight line is perpendicular to the second straight line.

A third straight line determined by one of the two antenna feeding points on each radiating patch and a center of the radiating patch 3 is parallel to the length direction of the metal frame 1, a fourth straight line determined by the other antenna feeding point and the center of the radiating patch 3 is parallel to the width direction of the metal frame 1, and the third straight line is perpendicular to the fourth straight line.

In this implementation, feeding is performed in an orthogonal feeding manner. In one aspect, a multiple-input multiple-output (namely, MIMO) function may be formed, to improve a data transmission rate. In another aspect, a wireless connection capability of the millimeter-wave antenna may be further increased, a communication disconnection possibility is reduced, and a communication effect and user experience are improved.

Optionally, the terminal device further includes a retractor 6. The retractor 6 is disposed in each groove, the radiating patch 3 in each groove is disposed between the retractor 6 and the bottom of the groove, there is a gap between each retractor 6 and the radiating patch 3, there is a gap between each retractor 6 and a sidewall of the groove, and an area of the retractor 6 is less than an area of the radiating patch 3.

In this implementation, the retractor 6 may be a same metal conductor as the metal frame 1, to keep metal appearance of the terminal device. For the radiating patch 3 and the retractor 6 in each groove, the gap between the retractor 6 and the radiating patch 3 may be optionally 0.2 mm, and the gap between the radiating patch 3 and the bottom of the groove may be optionally 0.4 mm. The area of the retractor 6 is less than the area of the radiation patch 3, so that the retractor 6 may perform better retraction on a signal irradiated by the radiation patch 3.

Figure 6:
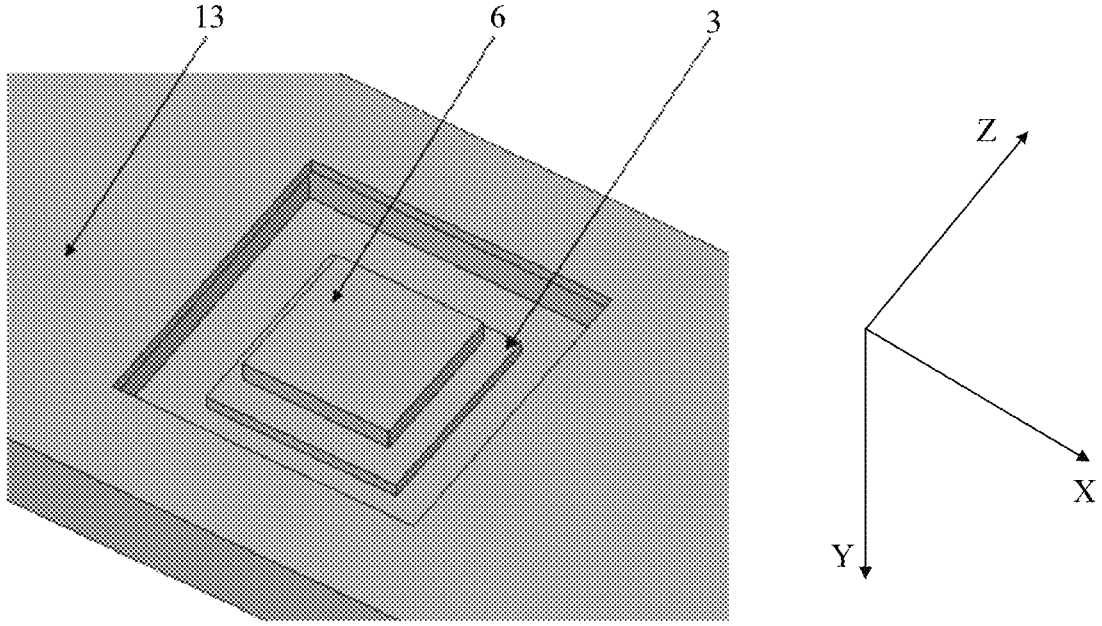
FIG. 6 is a schematic structural diagram 4 of a side of a metal frame according to some embodiments of the present disclosure.
Figure 7:
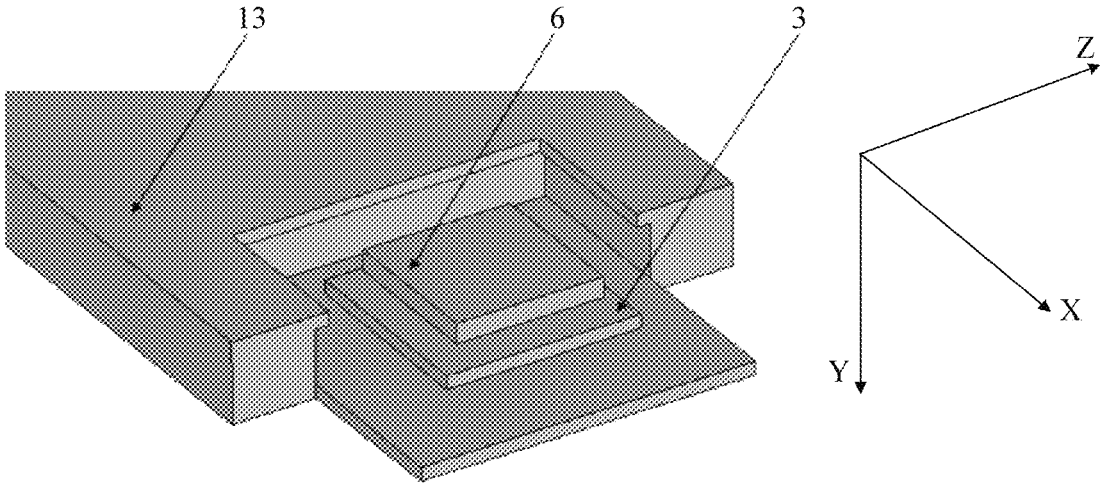
FIG. 7 is a schematic structural diagram 5 of a side of a metal frame according to some embodiments of the present disclosure.

For better understanding of the foregoing setting manner, refer to FIG. 6 to FIG. 9. FIG. 6 to FIG. 9 are schematic structural diagrams of a side of a metal frame according to some embodiments of the present disclosure. As shown in FIG. 6 and FIG. 7, the groove is disposed on the third side 13 of the metal frame 1, and the radiating patch 3 is disposed between the retractor 6 and the bottom of the groove.

Figure 8:
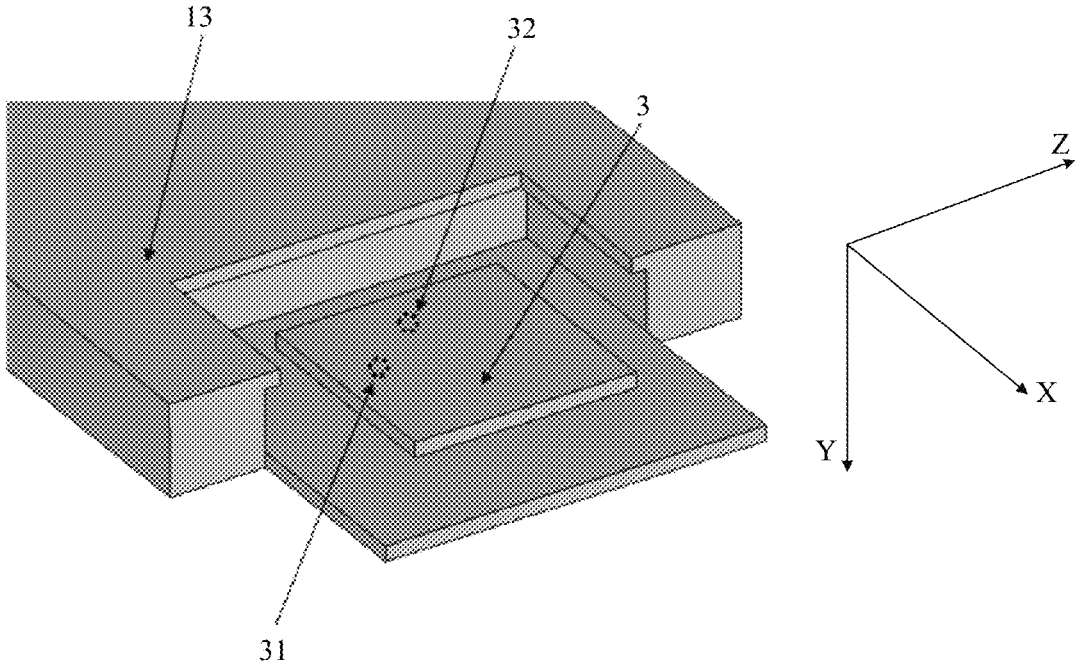
FIG. 8 is a schematic structural diagram 6 of a side of a metal frame according to some embodiments of the present disclosure.

FIG. 8 shows a structure formed after blocking of the retractor 6 is removed in FIG. 7. There are two antenna feeding points on the radiation patch 3, as shown by a first feeding point 31 and a second feeding point 32. The first feeding point 31 and the second feeding point 32 may be electrically connected to the feed to receive the first feed signal and the second feed signal.

Figure 9:
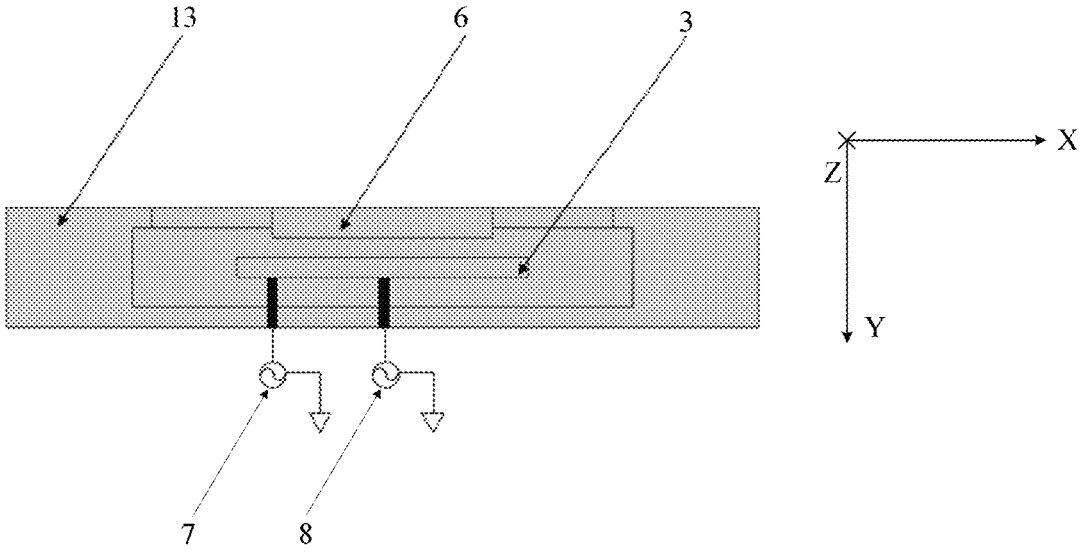
FIG. 9 is a schematic structural diagram 7 of a side of a metal frame according to some embodiments of the present disclosure.

As shown in FIG. 9, the groove is disposed on the third side 13 of the metal frame 1, and the radiating patch 3 is disposed between the retractor 6 and the bottom of the groove. In two antenna feeding points on the radiating patch 3, one receives a first feed signal 7, and the other receives a second feed signal 8.

Figure 10:
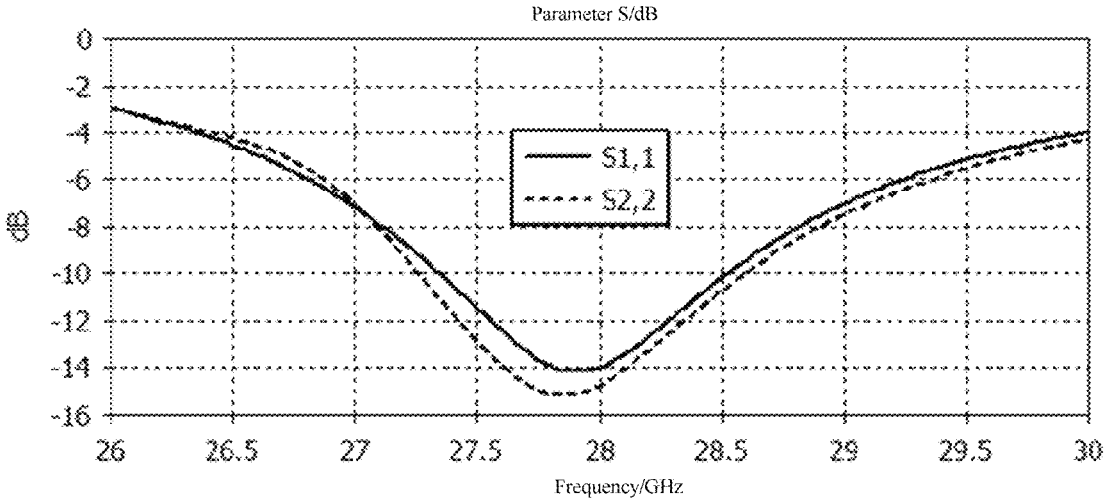
FIG. 10 is a schematic diagram 2 of a return loss of a single millimeter-wave antenna according to some embodiments of the present disclosure.

FIG. 10 is a schematic diagram of a return loss of a single millimeter-wave antenna according to some embodiments of the present disclosure. In this case, a single millimeter-wave antenna includes a radiating patch 3 and a retractor 6. As shown in FIG. 10, (S1, 1) is a return loss formed by a feeding signal of a first feed signal, and (S2, 2) is a return loss formed by a feeding signal of a second feed signal. (S1, 1) is −10 dB to calculate bandwidth, so that 27.35 GHz to 28.5 GHz can be covered.

Optionally, a surface of the retractor 6 that is away from the bottom of the groove is flush with a plane on which an outer sidewall of the metal frame 1 is located.

In this implementation, for better understanding of the foregoing setting manner, still refer to FIG. 9. The surface of the retractor 6 that is away from the bottom of the groove is flush with the plane on which the outer sidewall of the metal frame 1 is located, in other words, the surface of the retractor 6 that is away from the bottom of the groove is on a same plane as the plane on which the outer sidewall of the metal frame 1 is located. In this setting manner, relatively good appearance of the terminal device can be ensured.

Optionally, a shape of the groove, a shape of the radiating patch 3, and a shape of the retractor 6 are each a circle or a regular polygon.

In this implementation, the shape of the groove, the shape of the radiating patch 3, and the shape of the retractor 6 are each a circle or a regular polygon, so that different shapes may be set according to an actual requirement, to meet different performance of the millimeter-wave antenna, so that the terminal device has better adaptability. It should be noted that shapes of the groove, the radiating patch 3, and the retractor 6 may be the same or different. This is not limited in this implementation.

Optionally, the shape of the groove, the shape of the radiating patch 3, and the shape of the retractor 6 are each a square. Each gap between a side of the radiating patch 3 and a sidewall of the groove is equal, and each gap between a side of the retractor 6 and the sidewall of the groove is equal, so that relatively good symmetry can be ensured, and appearance can be relatively beautiful.

In addition, both a side length or a circumference of the radiating patch 3 and a side length or a circumference of the retractor 6 are less than a side length or a circumference of the groove, so that the terminal device may have relatively good appearance. It should be noted that if side lengths or circumferences of sidewalls of different depths of the groove change, both the side length or the circumference of the radiating patch 3 and the side length or the circumference of the retractor 6 are less than a minimum side length or a minimum circumference of the groove.

Optionally, a surface of the radiating patch 3 that is away from the bottom of the groove is flush with the plane on which the outer sidewall of the metal frame 1 is located.

In this implementation, the surface of the radiating patch 3 that is away from the bottom of the groove is flush with the plane on which the outer sidewall of the metal frame 1 is located. In this way, the millimeter-wave antenna has a simple structure, and at the same time, the radiating patch 3 is raised away from a ground structure in which the metal frame 1 is located, to improve efficiency performance of the millimeter-wave antenna and bandwidth of the millimeter-wave antenna. Certainly, in this way, the terminal device may have better appearance. For better understanding of the foregoing setting manner, refer to FIG. 3. In FIG. 3, the surface of the radiating patch 3 that is away from the bottom of the groove is flush with the plane on which the outer sidewall of the metal frame 1 is located.

Optionally, the at least two grooves are located on a same side of the metal frame 1.

In this implementation, the at least two grooves are located on a same side of the metal frame 1, so that millimeter-wave antennas on a same side may form a millimeter-wave array antenna, to receive or radiate a millimeter-wave signal. In addition, the at least two grooves may be located on a same side of the metal frame 1, so that setting of multiple grooves can be facilitated.

Optionally, the at least two grooves are arranged along the length direction of the metal frame 1. The at least two grooves may be in one row or multiple rows. This is not limited herein, and may be set based on an area of the frame.

In this implementation, the at least two grooves are arranged along the length direction of the metal frame 1. First, setting of multiple grooves on the metal frame 1 can be facilitated, to form the millimeter-wave array antenna.

Optionally, a gap between two adjacent millimeter-wave antennas is determined based on isolation between the two adjacent millimeter-wave antennas and performance of a beam scanning coverage angle of the array antenna.

In this implementation, the gap between two adjacent millimeter-wave antennas is determined by isolation between the two adjacent millimeter-wave antennas and the performance of the beam scanning coverage angle of the array antenna, to better match the millimeter-wave signal to work. It should be noted that the feed, the radiating patch 3, and the retractor 6 may form a millimeter-wave antenna, and the millimeter-wave antenna may implement a function of the millimeter-wave antenna.

Optionally, the grooves have a same diameter in a depth direction, or the grooves have different diameters in a depth direction. In one case, a diameter of the groove near the outer wall of the metal frame 1 is smaller than a diameter of the groove that is away from the outer wall of the metal frame 1.

In this implementation, for better understanding of the foregoing setting manner, refer to FIG. 7. In FIG. 7, a diameter of the groove in a Y-axis direction changes, in other words, on an outer surface of the metal frame 1, a side length of a square is relatively short and may be optionally 4.6 mm, and a side length of an inner square in the groove may be relatively long and may be optionally 5.0 mm, so that metal appearance of the terminal device can be optimized. Both a side length or a circumference of a square structure of the radiating patch 3 and a side length or a circumference of a square structure of the retractor 6 are less than the side length or the circumference of the groove.

Some embodiments of the present disclosure provide a terminal device, including a feed, a metal frame 1, and a radiating patch. At least two grooves are disposed on an outer surface of the metal frame 1, two through-holes are disposed in each groove, the radiating patch is disposed in each groove, the metal frame 1 is grounded, two antenna feeding points are disposed on each radiating patch, the feed is connected to one feeding point through one through-hole, the antenna feeding points in each groove are in a one-to-one correspondence with the through-holes, and each radiating patch is insulated from the groove by using a non-conducting material. Multiple millimeter-wave antennas form a millimeter-wave array antenna of the terminal device, and the metal frame 1 is also a radiator of a non-millimeter-wave communication antenna. Therefore, accommodating space of the millimeter-wave antenna is saved, a volume of the terminal device can be reduced, and a metal appearance design can be better supported and can be compatible with a solution in which appearance metal is used as another antenna, thereby improving overall competitiveness of the terminal device.

It should be noted that in this specification, the term "include", "including", or any other variant is intended to cover non-exclusive inclusion, so that a process, method, article, or apparatus that includes a series of elements includes not only those elements but also other elements that are not explicitly listed, or includes elements inherent to such a process, method, article, or apparatus. In the absence of more restrictions, an element defined by the statement "including a . . . " does not exclude another same element in a process, method, article, or apparatus that includes the element.

The embodiments of the present disclosure are described with reference to the accompanying drawings. However, the present disclosure is not limited to the foregoing specific implementations. The foregoing specific implementations are merely exemplary, but are not limiting. A person of ordinary skill in the art may make many forms without departing from the objective and the scope of the claims of the present disclosure.

The invention claimed is:

1. A terminal device, comprising a feed, a metal frame, and a radiating patch; wherein at least two grooves are disposed on an outer surface of the metal frame, two through-holes are disposed in each groove, the radiating patch is disposed in each groove, the metal frame is grounded, two antenna feeding points are disposed on each radiating patch, the feed is connected to one feeding point through one through-hole, the antenna feeding points in each groove are in a one-to-one correspondence with the through-holes, and each radiating patch is insulated from the groove by using a non-conducting material; and wherein the feed is a millimeter-wave feed, such that the radiating patch disposed inside the metal frame functions as a radiator of a millimeter-wave antenna of the terminal device, while the metal frame functions as a radiator of a non-millimeter-wave antenna of the terminal device.

2. The terminal device according to claim 1, wherein the two through-holes in each groove are located at the bottom of the groove.

3. The terminal device according to claim 2, wherein a first straight line determined by one of the two through-holes at the bottom of each groove and a center of the bottom of the groove is parallel to a length direction of the metal frame, a second straight line determined by the other through-hole and the center of the bottom of the groove is parallel to a width direction of the metal frame, and the first straight line is perpendicular to the second straight line; and a third straight line determined by one of the two antenna feeding points on each radiating patch and a center of the radiating patch is parallel to the length direction of the metal frame, a fourth straight line determined by the other antenna feeding point and the center of the radiating patch is parallel to the width direction of the metal frame, and the third straight line is perpendicular to the fourth straight line.

4. The terminal device according to claim 3, further comprising a retractor, wherein the retractor is disposed in each groove, the radiating patch in each groove is disposed between the retractor and the bottom of the groove, there is a gap between each retractor and the radiating patch, there is a gap between each retractor and a sidewall of the groove, and an area of the retractor is less than an area of the radiating patch.

5. The terminal device according to claim 4, wherein a surface of the retractor that is away from the bottom of the groove is flush with a plane on which an outer sidewall of the metal frame is located.

6. The terminal device according to claim 4, wherein a shape of the groove, a shape of the radiating patch, and a shape of the retractor are each a circle or a regular polygon.

7. The terminal device according to claim 6, wherein the shape of the groove, the shape of the radiating patch, and the shape of the retractor are each a square, gaps between a side of the radiating patch and the sidewall of the groove are equal, and gaps between a side of the retractor and the sidewall of the groove are equal.

8. The terminal device according to claim 1, wherein a surface of the radiating patch that is away from the bottom of the groove is flush with a plane on which an outer sidewall of the metal frame is located.

9. The terminal device according to claim 1, wherein the at least two grooves are located on a same side of the metal frame.

10. The terminal device according to claim 1, wherein the at least two grooves are arranged along the length direction of the metal frame.

11. The terminal device according to claim 1, wherein a diameter of the groove near an outer wall of the metal frame is less than a diameter of the groove that is away from the outer wall of the metal frame.

12. The terminal device according to claim 1, wherein the metal frame has four edges surrounding a screen of the terminal device.

* * * * *